United States Patent [19]

Kane

[11] Patent Number: 4,635,553

[45] Date of Patent: Jan. 13, 1987

[54] MANEUVERING AIR DISPENSED SUBMUNITION

[75] Inventor: Thomas A. Kane, Bedford, Mass.

[73] Assignee: Avco Corporation, Wilmington, Mass.

[21] Appl. No.: 787,452

[22] Filed: Oct. 15, 1985

[51] Int. Cl.[4] ..... F42B 25/24

[52] U.S. Cl. ..... 102/384; 102/388

[58] Field of Search ..... 102/384, 388, 393, 489; 244/3.21

[56] References Cited

U.S. PATENT DOCUMENTS

| | | | |
|---|---|---|---|
| 3,273,834 | 9/1966 | Bower | 102/388 |
| 4,356,770 | 11/1982 | Atanasoff et al. | 102/384 |
| 4,492,166 | 1/1985 | Purcell | 102/384 |
| 4,583,703 | 4/1986 | Kline | 102/388 |

OTHER PUBLICATIONS

Seidenman et al., "Sadarm"; *National Defense;* Oct. 1985; pp. 26–30.

*Primary Examiner*—Charles T. Jordan

*Attorney, Agent, or Firm*—Abraham Ogman; Robert J. McNair

[57] ABSTRACT

An air dispensed assembly in the form of a submunition cannister is disclosed which has the capability to perform a lateral maneuver during the final 1500 ft. of descent before impact. Maneuvering is accomplished by deploying a samara blade shaped wing from the rear of the submunition cannister after ejection from the casing of the launching shell. The wing is sized and provided with an angle of attack which causes the cylindrical shaped cannister to spin as it descends downward at approximately a constant rate of descent. A passive infrared sensor in the nose of the cannister provides target information to a data processor which generates steering commands to appropriately alter the wing angle of attack so as to bring about a corrective lateral change in direction. When within lethal range of the sensed target, the warhead in the submunition is detonated.

10 Claims, 11 Drawing Figures

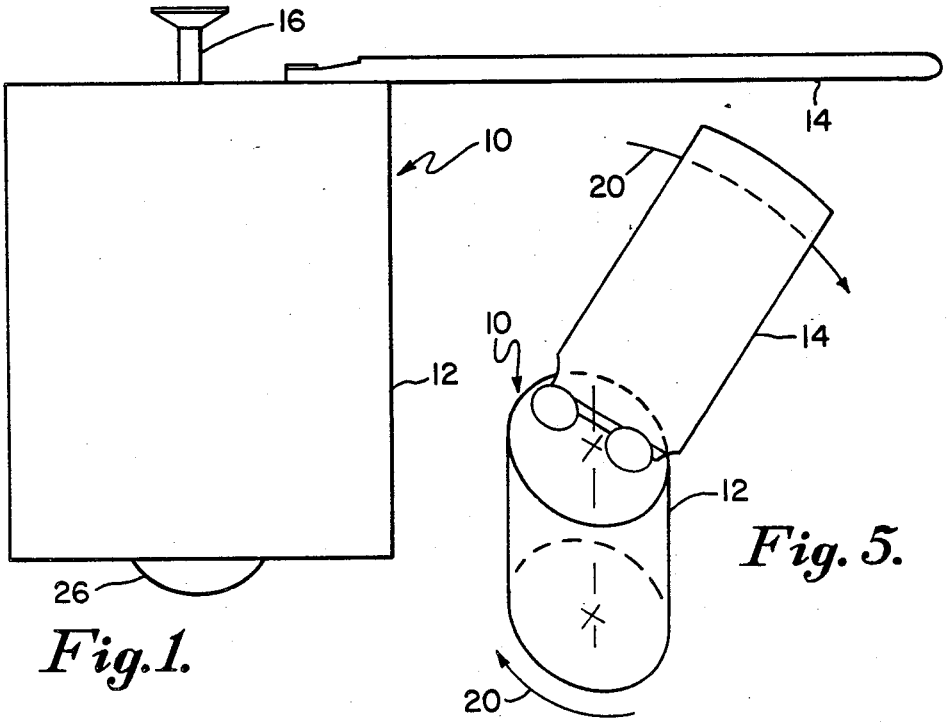
Fig. 1.
Fig. 5.
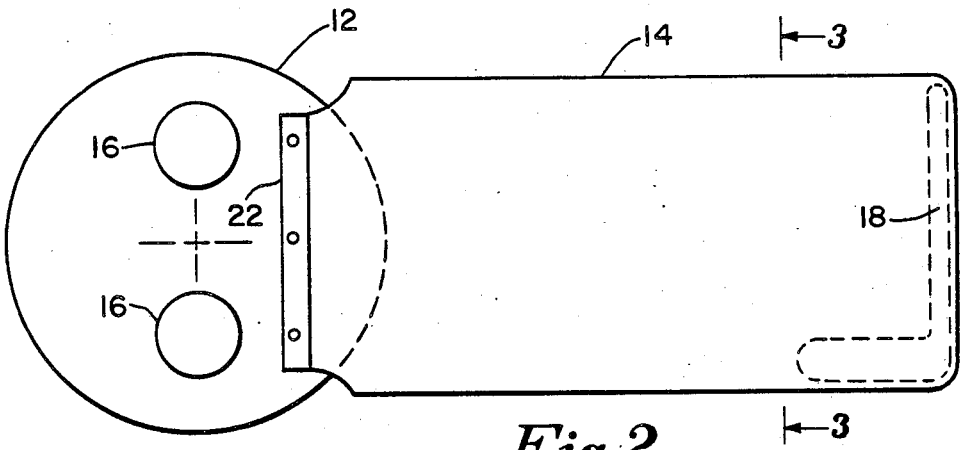
Fig. 2.
Fig. 3.
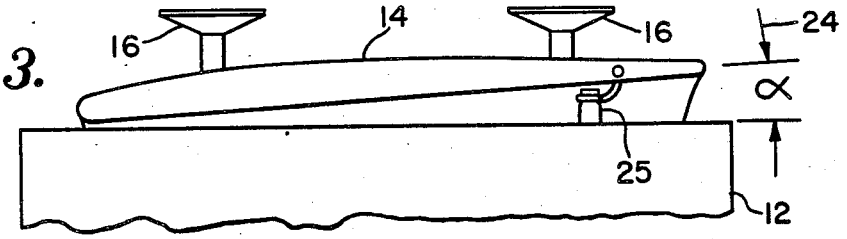

*Fig. 4A.*
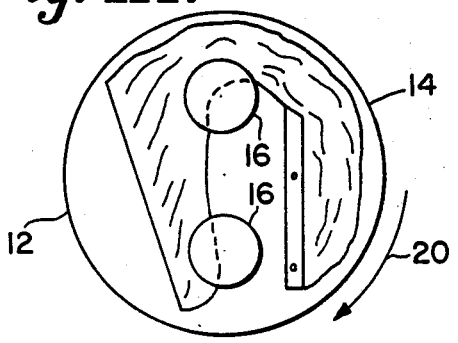
*Fig. 6.*
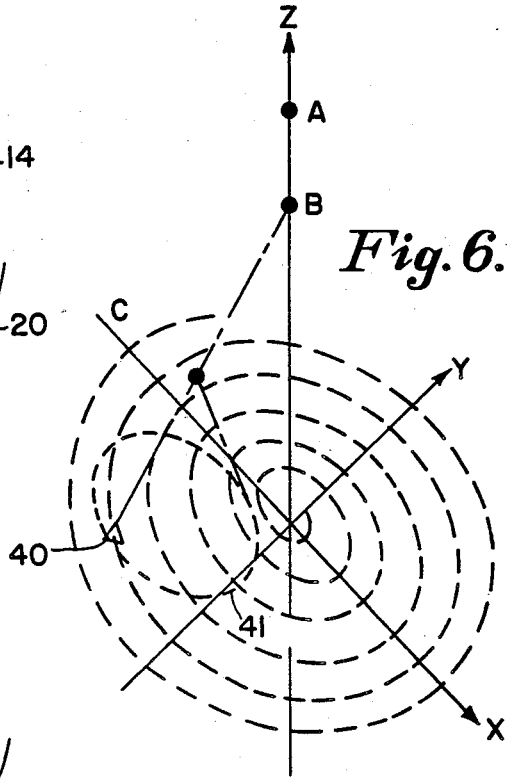
*Fig. 4B.*
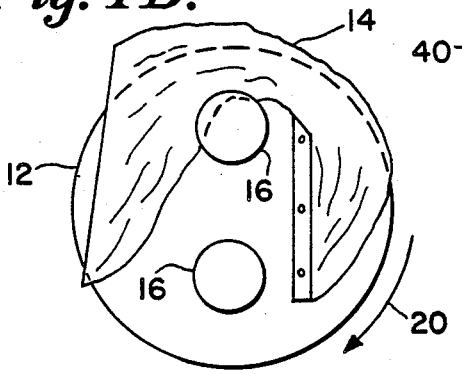
*Fig. 4C.*
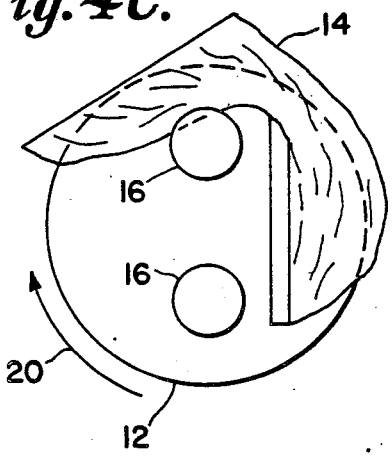
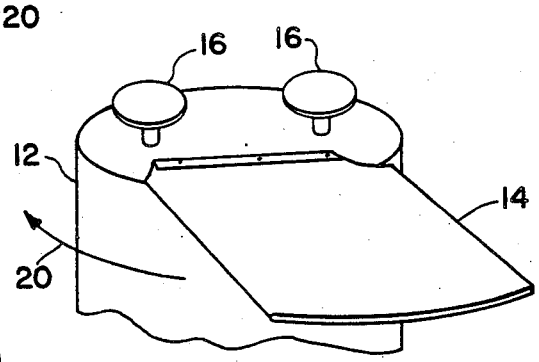
*Fig. 4D.*

*Fig. 7.*
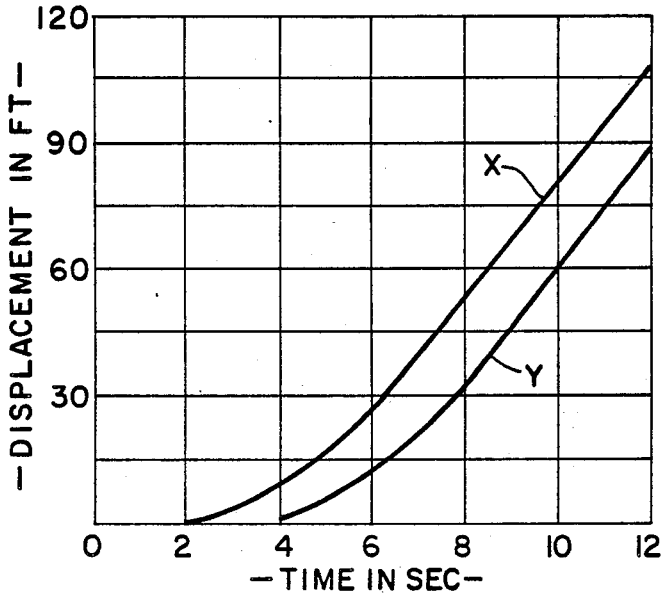
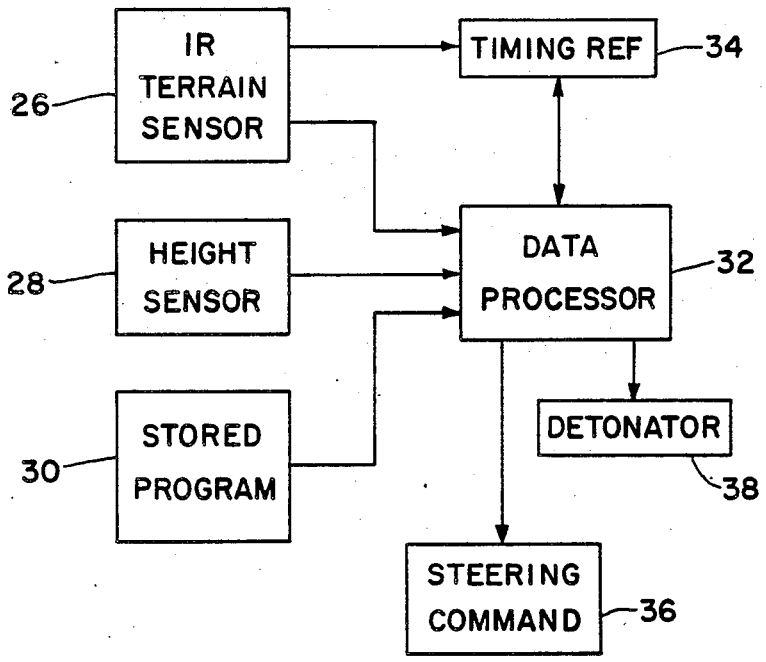
*Fig. 8.*

MANEUVERING AIR DISPENSED SUBMUNITION

BACKGROUND OF THE INVENTION

This invention enables an air dispensed assembly, described herein as a submunition to perform a lateral maneuver to bring it closer to a target. This increases the lethality and effectiveness of a top attack type of air launched submunition.

In the prior art, artillery shells were fired into an area along trajectories which were calculated to bring about impact on both moving and stationary targets. Better targeting was accomplished by having an observer view the impact area and radio instructions back to the launch site advising them of needed changes to account for corrections in windage and coriolis forces.

More recently, consideration has been given to the launching of large caliber shells which on arriving over the intended target area separate into several submunitions, each capable of destroying a ground target. Available miniaturized electronic circuitry provides the feasiblity for enabling each submunition to carry sensors and data processors that can recognize and home-in on a designated target within a specified search footprint. A samara blade is added to the submunition cannister which causes the submunition to spin as it descends downward much like a mapleseed falls from a tree in the springtime. My invention adds the rotation of the blade based on sensor input. By selectively changing the angle of attack of the blade as a function of rotational position, the submunition can be automatically steered toward a target. The potential energy that the submunition has due to the pull of gravity when descending from a higher to a lower altitude provides the accelerative forces needed to move the cannister sideways with respect to the original velocity vector.

SUMMARY OF THE INVENTION

An air dispensed top attack submunition is disclosed which has the capability to perform a lateral maneuver to increase the size of its effective search footprint for finding and destroying targets. Maneuvering is accomplished by attaching a samara blade to the rear of the cannister-like submunition. The samara blade acts as a wing which extends outward from only one side of the submunition. The wing has a negative angle of attack with respect to the horizontal plane causing the submunition to spin as it falls toward the ground much as a one bladed helicoper might autogyro in if it lost both power and tail rotor. By proper sizing of the wing, the descent rate of the submunition can be made nearly constant. The wing is made of a woven cloth-like material that allows it to be rolled up or folded when stowed in the shell prior to dispersal. It is weighted at the tip so that it quickly deploys due to centrifugal force when released in a spinning state from the shell at an altitude of about 1500 ft. above ground.

The submunition cannister contains an infrared and/or a millimeter wave sensor that senses ground targets. The offset samara blade causes a tilt angle and a spin rate with respect to the submunition center axis. This rotation allows the sensors to view an enlarged footprint on the ground. This footprint spirals inward as the submunition descends. When a hot spot is sensed, the data processor circuitry receives information from the sensor and generates commands which flex the wing in time with the rotation of the submunition. These commands steer the submunition toward the target as the descent progresses. When within lethal range, the submunition warhead is detonated.

Lateral manuevering is accomplished in either of two ways. One method is to use a control wire embedded in the wing. When actuated from the wing root, the control wire moves the angle of attack of the wing tip thereby serving to steer the submunition cannister out of its original flight path. When the wire is pulsed in synchronism with rotation of the submunition around its axis, acceleration toward a target site is achieved. Alternatively, the lateral maneuver can be accomplished by changing the angle of attack of the entire wing as a function of the rotational position of the blade. This approach is similar to that used with the rotor blade of a helicopter, however it would require a rigid blade.

BRIEF DESCRIPTION OF THE DRAWINGS

FIG. 1 is a side view of the submunition cannister with the wing extending outward from its top end.

FIG. 2 is a top view of the wing and cannister.

FIG. 3 is a cross sectional view of the wing taken along line 3—3 of FIG. 2.

FIGS. 4A through 4D are top views and an isometric view of the submunition showing the wing unfurling from its stowed position to its intermediate and finally deployed position.

FIG. 5 is an isometric view of the submunition depicting its spinning motion during descent toward target.

FIG. 6 is the 3-dimensional search footprint of the maneuvering submunition.

FIG. 7 is a graph of typical X and Y displacement with the wing being controlled at azimuthal frequency.

FIG. 8 is a block diagram of the control system used in the submunition.

DESCRIPTION OF THE PREFERRED EMBODIMENT

Referring to FIGS. 1–5, there is shown a submunition 10 comprising a warhead bearing cannister 12 having a horizontal maneuvering wing 14 attached to its upper end. When the submunition is in its stowed position within the shell casing (not shown) wing 14 is coiled as shown in FIG. 4. To make wing 14 flexible enough to coil, it was found expedient to make the wing from a woven fibrous material. It will be understood that the submunition is spinning as it is ejected from the shell casing. Once free of the casing centrifugal force will cause the wing to move from the position shown in FIG. 4A to that shown in FIG. 4D. When stowed in the shell casing, the woven fibrous wing 14 is wrapped around pins 16 positioned as shown on the end of cannister 12. With the cannister spinning as shown by arrow 20, the wing quickly unfurls as sequentially depicted in FIGS. 4A, 4B, 4C and 4D. Addition of a weight 18 at the tip of the wing insures that the wing deploys rapidly from the FIG. 4A state to the FIG. 4D state as soon as the submunition is free of the shell casing.

The spin rate (as shown by arrow 20) in FIG. 5 is 30 revolutions per second. A typical value for weight 18 is 1.5 ozs. for a 9 lb. cannister. The effective span of wing 14 is 7.5 in. and the wing cord is 4 in. It is anticipated that wings of other dimensions will also work. For example, a wing of 3 in. cord and 12 in. span should also be effective. Calculating the centrifugal force which holds the wing in the deployed position shown in FIG. 1 makes use of the formula $$F = W/g(2\pi n)^2 l$$

where

W = weight at the tip of the wing g = 32.17 ft/sec$^2$ n = 30 rev/sec l = distance from center of rotation to wing tip Using the values implemented in the preferred embodiment, the centrifugal force maintaining the wing in an extended position calculates to a value of approximately 123 lbs. for a cannister 12 having a diameter of 4.5 in. This is adequate to hold wing 14 rather rigid as shown in FIG. 1. Wing 14 attaches to the top surface of cannister 12 along the diameter of the cannister. Attachment can be by any appropriate means such as a clamp at location 22 at the root of the wing (see FIG. 2).

FIG. 6 shows the sequence of events subsequent to the time a submunition is ejected from a carrier shell and ready for steering toward a target. Point A represents the ejection of the submunition from a carrier shell some 1500 ft. above the ground. The submunition will descend from Point A to Point B before the sensor can discover a target 40 located at ground level. In the submunition reduced to practice the target sensor consisted of an infrared detector 26 positioned at the center of the lower face of the cannister (see FIG. 1). On being launched from the carrier shell the submunition is programmed to activate IR sensor 26 to initiate the search for a target. The sensor will detect hot spots on the ground which might for example be an internal combustion engine in a truck. Once a target is detected, the submunition is ready to maneuver toward the target. When target 40 is within the lethal footprint of the warhead, detonation of the munition can occur. Point C in FIG. 6 is representative of the altitude at which the submunition becomes effective in destroying target 40 which is now within lethal footprint 41.

Maneuvering the submunition toward the target is accomplished by changing the angle of attack of wing 14 (see FIG. 3). In FIG. 3 the angle of attack is represented by arrows 24. The angle of attack in one implementation (not shown) was changed by moving the wing tip up and down with respect to the cannister. This was done by cyclically twisting a control wire which was embedded in and ran the length of wing 14. This approach is depicted in FIGS. 3 and 4 wherein the post 25 pushes upward and retracts downward from the top face of cannister 12. Since very little inertia needs to be overcome to flex the rear edge of the woven fibrous wing, a simple solenoid can be used to accomplish changes in the angle of attack.

FIG. 8 is a block diagram of the control system used. Infrared terrain sensor 26 scans downward from the cannister. When a hot spot is sensed a timing reference 34 is determined establishing the X-Y coordinates for the subsequent maneuvering action. A height sensor 28 provides a second input to a data processor 32. The data processor operates from a simple stored program 30. The data processor generates steering commands which cyclically flex wing 14 (see FIG. 5) so that the submunition maneuvers over the target. When the height sensor 26 identifies the target as being within the lethal range of the munition, data processor 32 generates a command for detonator circuit 38. FIG. 7 shows what can be accomplished by the maneuvering submunition launched at an elevation of 1500 ft. above the ground. Periodically varying the angle of attack of the wing as the submunition spins at 30 revolutions per second brings about a lateral velocity. Plotting lateral displacement as a function of time after launch shows the result graphed in FIG. 7. During a change in elevation of approximately 1200 ft., it was possible to maneuver the submunition some 85 ft. along the Y axis and 105 ft. along the X axis. By performing a lateral maneuver of the submunition in a direction of a sensed target it is possible to appreciably increase the effective search footprint and lethality of the submunition.

By employing the same laws of physics used by nature in configuring a mapleseed, it is possible to provide a submunition with a wing which allows it to descend at a rather constant rate of 105 ft/sec. At the same time the size of the wing surface, the weight of the assembly and the inertial constants can be chosen so that the characteristic frequency of rotation allows the submunition to spin in at 30 revolutions per second. Due to the weight incorporated in the wing tip there is some nutation of the axis of cannister 12 as the submunition spins downward. This expands the field of search of the infrared sensor, providing an enlarged footprint as compared to a non-maneuvering submunition.

While there has been shown and described what is at present considered to be the preferred embodiment of the invention, it will be obvious to those skilled in the art that various changes and modifications may be made therein without departing from the true scope of the invention as defined in the appended claims.

What is claimed is:

1. An air dispensed submunition having the capability to perform a lateral maneuver during descent onto a target area, the submunition comprising:

a cannister having an axis and a generally cylindrical shape, said cannister containing a warhead capable of detonation;

means for inducing spin to said cannister about its longitudinal axis;

a wing attached by its one end to the top end of said cannister, the second end of said wing extending outwardly at right angles to the axis of said cannister, the chord of said wing having an angle of attack sufficient to impart a rotation torque to said submunition during descent;

sensor means for detecting targets of opportunity in the search footprint area below said descending submunition, said search footprint field of view being larger than the lethal range of said warhead;

data processor means for generating steering commands from target information gathered by said sensor means;

a means acting on said wing for changing the angle of attack thereof in response to said steering commands for maneuvering said submunition within lethal range of said target; and signal activation means to generate a detonation command to explode said warhead.

2. A submunition as described in claim 1 wherein said wing is constituted of flexible materials allowing it to be wrapped up for stowage on the top end of said cannister during the launch phase of deployment.

3. A submunition as defined in claim 2 and including a weight at the tip of said wing which when acted upon by centrifugal force brings about rapid erection of said wing to its extended state.

4. A submunition as defined in claim 1 wherein said sensor means comprises a passive infrared detection system.

5. A submunition as defined in claim 1 wherein said means acting on said wing makes use of a solenoid which rotates the tip of said wing thus adjusting the angle of attack thereof in response to steering commands generated by said data processor.

6. A submunition as defined in claim 1 wherein the means for inducing spin to said cannister includes ejection from a shell casing in a spinning condition at approximately 1500 feet above the target.

7. A submunition as defined in claim 1 wherein the span and chord dimensions of said wing are selected to bring about a constant rate of descent for said cannister.

8. A submunition as defined in claim 7 wherein the rate of descent is approximately 105 feet per second for a submunition having a spin rate of 30 revolutions per second.

9. A submunition as defined in claim 1 wherein said wing has the shape of a samara blade.

10. An air dispensed assembly having the capability to perform a lateral maneuver during descent, the assembly comprising:

a cannister having an axis and a generally cylindrical shape;

means for inducing spin to said cannister about its longitudinal axis;

a wing attached by its one end to said cannister, the second end of said wing extending outwardly at right angles to the axis of said cannister, the chord of said wing having an angle of attack sufficient to impart a rotation torque to said submunition during descent;

sensor means for detecting objects in a search footprint area below said descending assembly;

means for generating steering commands from target information gathered by said sensor means; and a means acting on said wing for changing the angle of attack thereof in response to said steering commands for maneuvering said cannister laterally toward said object.

* * * * *